US006793159B2

(12) United States Patent
Bloching et al.

(10) Patent No.: US 6,793,159 B2
(45) Date of Patent: Sep. 21, 2004

(54) FUEL INJECTOR

(75) Inventors: Wolfgang Bloching, Langenargen (DE); Willibald Schürz, Pielenhofen (DE)

(73) Assignee: Seimens Aktiengesellschaft, Munich (DE)

( * ) Notice: Subject to any disclaimer, the term of this patent is extended or adjusted under 35 U.S.C. 154(b) by 0 days.

(21) Appl. No.: 10/464,698

(22) Filed: Jun. 18, 2003

(65) Prior Publication Data

US 2003/0218080 A1 Nov. 27, 2003

Related U.S. Application Data

(63) Continuation of application No. PCT/DE01/04671, filed on Dec. 12, 2001.

(30) Foreign Application Priority Data

Dec. 18, 2000 (DE) ..... 100 63 083

(51) Int. Cl.[7] ..... F02M 59/00; F02M 39/00; B05B 1/30

(52) U.S. Cl. ..... 239/533.2; 239/533.3; 239/533.9; 239/585.1; 239/585.5; 239/88

(58) Field of Search ..... 239/533.2, 533.3, 239/533.9, 585.1, 585.2, 585.3, 585.4, 585.5, 88, 89, 90, 91; 251/129.15, 129.21, 127

(56) References Cited

U.S. PATENT DOCUMENTS

| | | | | | |
|---|---|---|---|---|---|
| 3,115,304 | A | | 12/1963 | Humphries | 239/90 |
| 4,566,416 | A | | 1/1986 | Berchtold | 123/458 |
| 5,638,791 | A | * | 6/1997 | Tsuzuki et al. | 123/467 |
| 5,687,693 | A | * | 11/1997 | Chen et al. | 123/446 |
| 5,878,720 | A | | 3/1999 | Anderson et al. | 123/496 |
| 5,913,300 | A | * | 6/1999 | Drummond | 123/467 |
| 6,109,542 | A | | 8/2000 | Morris et al. | 239/88 |

* cited by examiner

*Primary Examiner*—Davis Hwu
(74) *Attorney, Agent, or Firm*—Baker Botts L.L.P.

(57) ABSTRACT

The fuel injector comprises a control module, with a piston guide extending downwards, in which a control piston is arranged. The fuel injector further comprises a nozzle body, with a top surface on which the control module is mounted. The nozzle body comprises a drilling with a nozzle needle, co-operating with the control piston, arranged in the lower section thereof and the piston guide, arranged in the upper section thereof. A high pressure inlet is arranged in the control module and opens out into the drilling at the top surface. The drilling is embodied such that, on lifting the nozzle needle from the valve seat thereof, the fuel which escapes from the fuel injector is replaced, whereby fuel from the high pressure inlet flows through the drilling in the direction of the valve seat.

15 Claims, 2 Drawing Sheets

FUEL INJECTOR

CROSS-REFERENCE TO RELATED APPLICATION

This application is a continuation of co-pending International Application No. PCT/DE01/04671 filed Dec. 12, 2001 which designates the United States, and claims priority to German application number DE10063083.9 filed Dec. 18, 2000.

TECHNICAL FIELD OF THE INVENTION

The invention relates to a fuel injector.

BACKGROUND OF THE INVENTION

When using a fuel injector, precisely metered quantities of fuel are injected into in a combustion chamber of an internal combustion engine. With regard to future common rail injection systems, the fuel is intended to be injected at a pressure of up to 2000 bar, for which reason efforts are being made to design fuel injectors capable of handling particularly high pressure.

A conventional fuel injector will be described in detail in the following with reference to FIG. 1 which shows a cross-section through the fuel injector.

The fuel injector comprises an actuator housing GA' and an actuator unit A' arranged therein which has an operative connection by way of a lever H' and a valve piston V' with a control valve S'. The control valve S', which is arranged in a valve chamber VK', separates a control chamber SK' from a return line R'. The control chamber SK' is arranged beneath the valve chamber VK' and connected by way of an outlet restrictor AD' to the valve chamber VK'. The valve chamber VK' is arranged in a control module ST'.

The control chamber SK' lies adjacent to an upper end of a control piston K'. The control piston K' is arranged so as to be movable inside a drilled hole in a piston module KM' and lies adjacent to side surfaces of the piston module KM' which are formed by the drilled hole. The drilled hole thus serves as a guide for the control piston K'.

The control piston K' is connected to a coupling rod KS' which is arranged in a spring pocket F'. The spring pocket F' is arranged in the piston module KM' and is connected to the return line R' such that a low pressure exists in the spring pocket F'. The coupling rod KS' has a spring plate T'. A spring FE' is tensioned between the spring plate T' and the control piston K'.

The coupling rod KS' is in contact with a nozzle needle D' which is arranged in a drilled hole in a nozzle body DK' arranged beneath the piston module KM'. The drilled hole in the nozzle body DK' has a high pressure chamber HK' into which a high pressure inlet Z' opens out which extends from the control module ST' as far as the high pressure chamber HK'. An inlet restrictor ZD' is arranged between the high pressure inlet Z' and the control chamber SK'.

When the actuator unit A' is actuated, then the control valve S' is opened so that fuel drains from the valve chamber VK' by way of the return line R'. As a result, fuel flows from the control chamber SK' by way of the outlet restrictor AD' into the valve chamber VK' and it actually flows more quickly than fuel flows from the high pressure inlet Z' by way of the inlet restrictor ZD' into the control chamber SK'. As a consequence of this, the pressure in the control chamber SK' falls such that the force acting from above on the nozzle needle D' is reduced and the nozzle needle D' lifts from its valve seat. As a result, fuel issues from the fuel injector.

When the actuator unit A' is deactivated, then the control valve S' closes so that a pressure is built up once again in the control chamber SK' by way of the inlet restrictor ZD'. As a result of the spring FE', as a result of the low pressure in the spring pocket F' and as a result of the hydraulic force resulting on the basis of the greater cross-sectional area of the control piston K' when compared with the cross-sectional area of the nozzle needle D' in the area of the guide in the nozzle body DK' just a small rise in pressure in the control chamber SK' is sufficient in order to press the nozzle needle D' downwards against its valve seat such that the fuel injector closes quickly.

A disadvantage associated with the conventional fuel injector is the tapering and thin wall of the nozzle body in the area where the high pressure inlet opens out into the high pressure chamber. The resistance to high pressure of the fuel injector is consequently not very high.

A further disadvantage consists in the fact that a continuous leakage occurs between the high pressure chamber and the spring pocket in which a low pressure prevails, and between the spring pocket and the control chamber, which leads to a loss in the efficiency of the fuel injector. The greater the pressure difference between the high pressure chamber or the control chamber and the spring pocket, the more pronounced is the continuous leakage.

SUMMARY OF THE INVENTION

The object of the invention is to set down a fuel injector which is suitable for higher pressures when compared with the prior art.

This object can be achieved by a fuel injector having the following features: The fuel injector comprises a control module with a piston guide extending downwards, in which a control piston is arranged. The fuel injector further comprises a nozzle body with a top surface on which the control module is mounted and which has a drilled hole in whose lower section is arranged a nozzle needle which has an operative connection with the control piston and in whose upper section is arranged the piston guide of the control module. A high pressure inlet which opens out into the drilled hole at the top surface is arranged in the control module. The drilled hole is designed such that fuel which escapes from the fuel injector when the nozzle needle lifts from its valve seat is replaced, whereby fuel from the high pressure inlet flows through the drilled hole in the direction of the valve seat. High pressure is thus applied to the entire drilled hole.

Since the high pressure inlet opens out into the drilled hole of the nozzle body at the top surface of the nozzle body and thus does not open out sideways into a drilled hole, no tapering thin wall which would be at risk of failure under high pressure conditions is present between the drilled hole and the high pressure inlet. The fuel injector therefore exhibits a high resistance to pressure and is thus suitable for high pressures.

Since the high pressure inlet is arranged only in the control module and not in the nozzle body where the construction space particularly in the lower section is greatly restricted, the problem of walls which are too thin for high pressures around the high pressure inlet does not generally arise.

A valve chamber is provided, for example, which is separated from a return line by means of a control valve. In addition, the fuel injector can comprise a control chamber which lies adjacent to the upper end of the control piston. High pressure is applied to the control chamber by way of an inlet restrictor, whereby the inlet restrictor is connected hydraulically to the high pressure inlet. The inlet restrictor is thus connected at least indirectly to the high pressure inlet. The valve chamber and the control chamber are connected to one another by way of an outlet restrictor.

In order to guarantee rapid closure of the fuel injector, as a result of the absence of a difference in cross-sectional area between control piston and nozzle needle in the area of the guide in the control module and thus of the absence of the hydraulic force component in the direction of closure of the nozzle needle it is advantageous to provide a bypass restrictor, by way of which high pressure is applied to the valve chamber, whereby the bypass restrictor is connected hydraulically to the high pressure inlet. The bypass restrictor is thus connected at least indirectly to the high pressure inlet in hydraulic terms. When the control valve lifts from its valve seat, then fuel drains off from the valve chamber into the return line. Fuel drains off from the control chamber through the outlet restrictor more quickly than can flow into the control chamber through the inlet restrictor, which causes the pressure in the control chamber to fall, as a result of which the nozzle needle lifts from its valve seat and fuel issues from the fuel injector. At the same time, fuel flows into the valve chamber by way of the bypass restrictor. When the control valve is closed, then the pressure builds up in the control chamber as a result of fuel flowing through the inlet restrictor. The pressure buildup and thus the lowering of the nozzle needle onto its valve seat—in other words the closure of the fuel injector—is accelerated by means of the bypass restrictor because fuel flows into the valve chamber by way of the bypass restrictor and thence by way of the outlet restrictor into the control chamber.

In order to ensure fixed positioning of the control module with respect to the nozzle body it is advantageous if the piston guide comprises at least three projections directed radially outwards which lie adjacent to side surfaces of the nozzle body that are formed by the drilled hole. The spaces between the projections form channels for the fuel.

The projections can run along the entire axial length of the piston guide.

It is however advantageous if the piston guide in the area of the upper end of the drilled hole is spaced from the side surfaces of the needle body, which are formed by the drilled hole, such that an annular channel is formed for the fuel. In this case, the projections are merely arranged in a lower section of the piston guide. In this case, the bypass restrictor can lie adjacent to a bypass drilled hole arranged in the control module, which bypass drilled hole opens out into the annular channel. Rapid transportation of the fuel from the high pressure inlet into the bypass drilled hole is guaranteed as a result of the annular channel. The advantageous aspect of such an arrangement is the fact that the bypass drilled hole is spaced from the high pressure inlet and that consequently the construction space in the control module is better utilized. Walls around the high pressure inlet or around the bypass drilled hole that are too thin for a high pressure are also avoided as a result.

The projections on the piston guide are preferably arranged symmetrically around the axis of the drilled hole.

In order to reduce the resistance to flow of the fuel, it lies within the scope of the invention to provide a radial projection for the drilled hole which extends at least over the axial length of the piston guide and into which the high pressure inlet opens out. In this case, projections for the piston guide are not required but are possible.

The inlet restrictor can be connected directly to the high pressure inlet.

Alternatively, the inlet restrictor is connected to the annular channel, in other words it is connected only indirectly to the high pressure inlet whereas the bypass drilled hole is connected directly to the high pressure inlet.

In order to simplify the manufacturing process, it is advantageous for the nozzle needle and the control piston to be formed as a single piece. In this case, the piston guide is used as a guide both for the control piston and also for the nozzle needle.

In order to reduce the resistance to flow of the fuel in the drilled hole, it is advantageous for the nozzle needle to be spaced from side surfaces of the nozzle body which are formed by the drilled hole.

The dimensions of the control piston are adapted to the dimensions of the piston guide in such a way that no channel is produced for the fuel inside the piston guide.

Alternatively, the nozzle needle and the control piston are not formed as a single piece. In this case a needle guide, adjacent to which is located the nozzle needle such that at least one channel is formed for the fuel flow, is provided inside the drilled hole.

In order to increase the closing force of the nozzle needle, it is advantageous for a spring to be provided in the drilled hole, which pre-tensions the nozzle needle in a downward direction. For example, the nozzle needle comprises a spring plate, whereby the spring is tensioned between the spring plate and the lower end of the piston guide.

An embodiment of the invention will be described in the following with reference to FIGS. 2 and 3.

Figure 2:
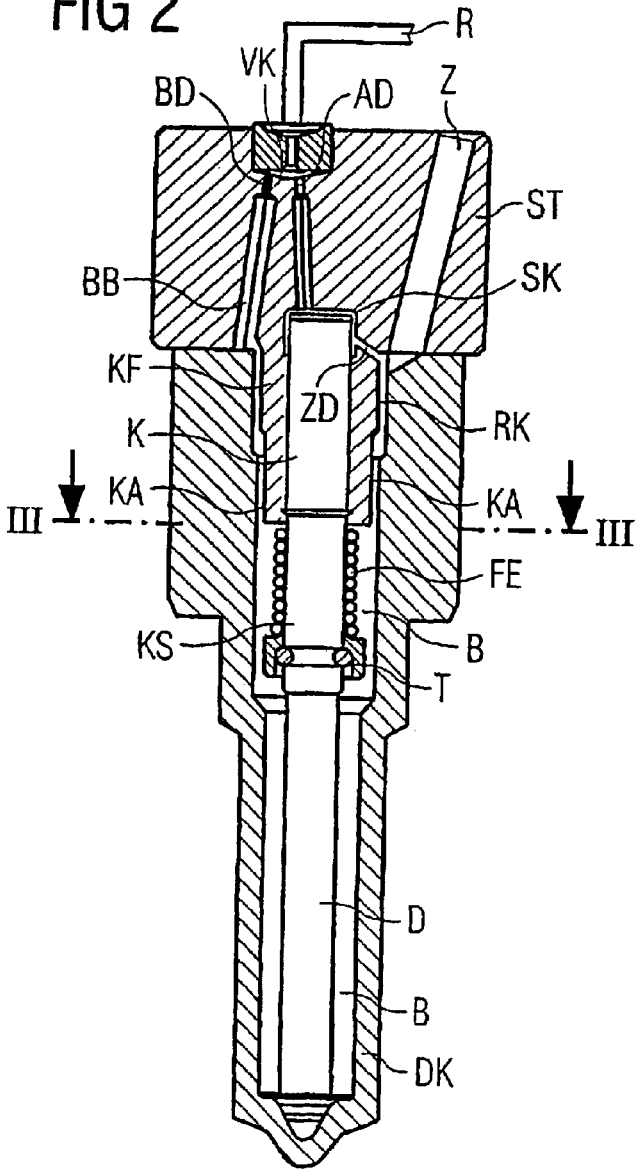

FIG. 2 shows a cross-section through a fuel injector having a control module, a nozzle body, a nozzle needle, a control piston, a control guide, a spring plate, a spring, a drilled hole, an inlet restrictor, a bypass restrictor, an outlet restrictor, a bypass drilled hole, a valve chamber, a control chamber, an annular channel, channels, a control valve, a high pressure inlet and a return line.

Figure 3:
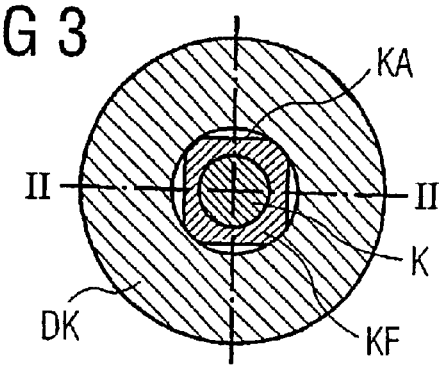

FIG. 3 shows a cross-section, perpendicular to the cross-section shown in FIG. 2, through the fuel injector, in which the nozzle body, the channels, the piston guide and the control piston are shown.

DETAILED DESCRIPTION OF THE PREFERRED EMBODIMENTS

In the embodiment, a fuel injector is provided with a control module ST and a nozzle body DK. The control module ST comprises a piston guide KF extending downwards which is inserted into a drilled hole B in the nozzle body DK. The control module ST is mounted on a top surface of the nozzle body DK.

In an upper section of the piston guide KF, the piston guide KF has an annular horizontal cross-section. In a lower section of the piston guide KF adjoining the upper section, the piston guide KF has a horizontal cross-section which is produced from an annular cross-section as a result of axial grinding at four points (see FIG. 2). The lower section of the piston guide thus comprises four radially orientated projections which lie adjacent to side surfaces of the nozzle body DK that are formed by the drilled hole B. The spaces between the projections form channels KA for the fuel. In the area of the upper section of the piston guide KF the drilled hole B has a greater horizontal cross-section than in the area of the lower section of the piston guide KF, with the result that an annular channel RK is formed between the drilled hole B and the upper section of the piston guide KF.

Figure 1:
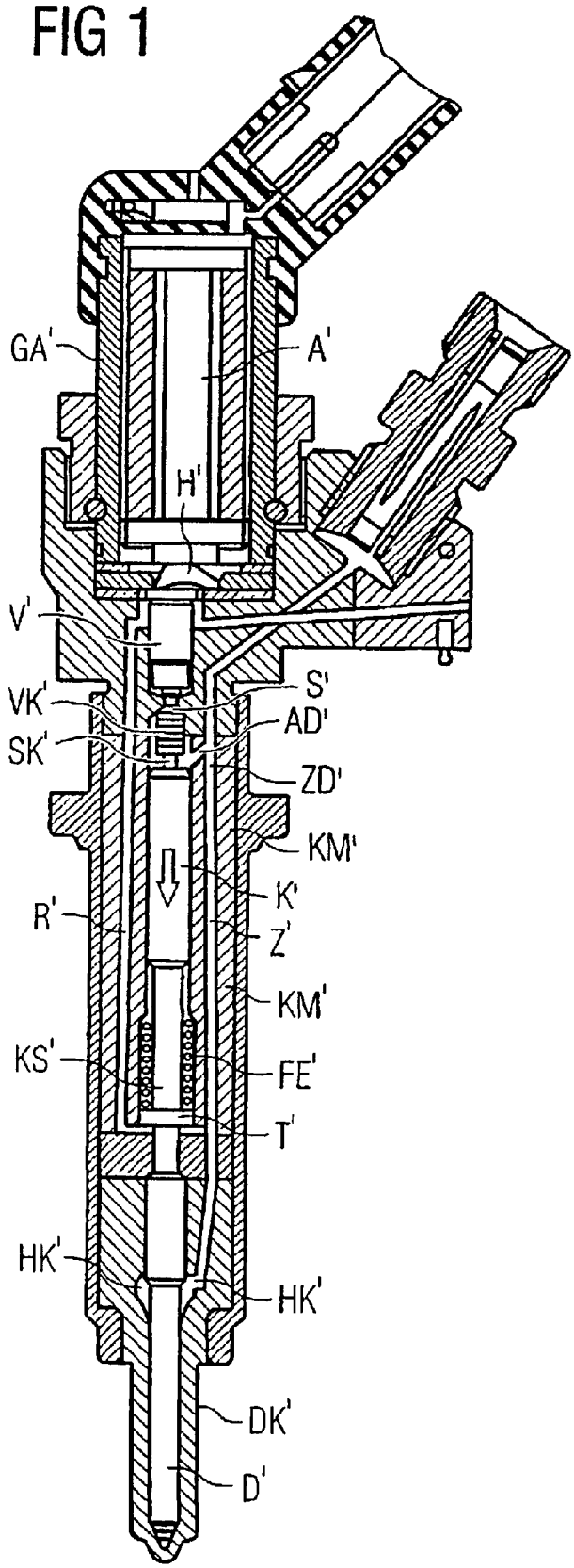
FIG. 1 shows a cross-section of a fuel injector.

The piston guide KF is hollow and encloses a control piston K arranged so as to be movable in the piston guide KF. A control chamber SK is arranged above the control piston K in the piston guide KF. Above the control chamber SK is arranged a valve chamber VK which is separated from a return line R by means of a control valve S. The valve chamber VK is connected by way of an outlet restrictor AD to the control chamber SK (see FIG. 1)

In the control module ST is arranged a high pressure inlet Z which opens out into the drilled hole B—more precisely, into the annular channel RK—on the top surface. In the area of the top surface the high pressure inlet Z is connected to the control chamber SK by way of an inlet restrictor ZD (see FIG. 1).

In the control module ST is arranged a bypass drilled hole BB which opens out into the annular channel RK and is connected by way of a bypass restrictor BZ to the valve chamber VK.

In the drilled hole B is arranged a coupling rod KS which is formed in one piece with the control piston K. A spring plate T is arranged on the coupling rod KS. A spring FE is tensioned between the spring plate T and the lower end of the piston guide KF.

In the drilled hole B is arranged a nozzle needle D which is formed in one piece with the coupling rod KS and the control piston K. The nozzle needle D and the coupling rod KS are spaced from the side surfaces of the nozzle body DK which are formed by the drilled hole B.

When the control valve S is opened, then fuel flows from the valve chamber VK into the return line R, as a result of which fuel flows from the control chamber SK by way of the outlet restrictor AD and fuel flows by way of the bypass restrictor BD into the valve chamber VK. Less fuel flows from the high pressure inlet Z by way of the inlet restrictor ZD into the control chamber SK than flows out of the control chamber SK, with the result that the pressure in the control chamber SK falls. As a consequence of this, a resulting upward force acts on the nozzle needle D, causing the nozzle needle D to lift from is valve seat, and fuel contained in the drilled hole B issues from the fuel injector.

This fuel is replaced by fuel being pumped by way of the high pressure inlet Z into the annular channel RK, whence it flows by way of the channels KA to the nozzle needle D.

When the control valve S is closed, then the pressure in the control chamber SK builds up, whereby fuel flows from the high pressure inlet Z by way of the inlet restrictor ZD and from the high pressure inlet Z by way of the annular channel RK, from the bypass drilled hole BB, from the bypass restrictor BD, from the valve chamber VK and from the outlet restrictor AD into the control chamber SK.

As a result of the rising pressure in the control chamber SK and of the force of the spring FE the nozzle needle D is again forced onto its valve seat.

What is claimed is:

1. A fuel injector comprising:

a control module which comprises a piston guide extending downwards in which a control piston is arranged, a nozzle body with a top surface on which the control module is mounted, and comprising a drilled hole in whose lower section is arranged a nozzle needle having an operative connection with the control piston and in whose upper section is arranged the piston guide, wherein a high pressure inlet is arranged in the control module and this opens out into the drilled hole at the top surface, and wherein the drilled hole is designed in such a way that fuel which issues from the fuel injector when the nozzle needle lifts from its valve seat is replaced by fuel flowing from the high pressure inlet by way of the drilled hole in the direction of the valve seat.

2. The fuel injector according to claim 1, wherein in order to ensure fixed positioning of the control module with respect to the nozzle body, the piston guide comprises at least three radially orientated projections which lie adjacent to side surfaces of the nozzle body formed by the drilled hole, and wherein the spaces between the projections form channels for the fuel.

3. The fuel injector according to claim 2, wherein the piston guide in the area of the upper end of the drilled hole is spaced from the side surfaces of the needle body, which are formed by the drilled hole, such that an annular channel is formed for the fuel.

4. The fuel injector according to claim 3, wherein the bypass restrictor lies adjacent to a bypass drilled hole arranged in the control module, which bypass drilled hole opens out into the annular channel.

5. The fuel injector according to claim 1, further comprising a valve chamber which is separated from a return line by means of a control valve, in which high pressure is applied to the valve chamber by way of a bypass restrictor, whereby the bypass restrictor is connected hydraulically to the high pressure inlet, having a control chamber which lies adjacent to the upper end of the control piston, wherein high pressure is applied to the control chamber by way of an inlet restrictor, whereby the inlet restrictor is connected hydraulically to the high pressure inlet, and wherein the valve chamber and the control chamber are connected to one another by way of an outlet restrictor.

6. The fuel injector according to claim 1, wherein the nozzle needle and the control piston are formed as a single piece, and wherein the nozzle needle is spaced from the side surfaces of the needle body, which are formed by the drilled hole.

7. A fuel injector comprising:

a control module comprising: a piston guide extending downwards in which a control piston is arranged, a nozzle body with a ton surface on which the control module is mounted, and comprising a drilled hole having a lower section with a nozzle needle, wherein the nozzle needle has an operative connection with the control piston and wherein the piston guide is arranged in its upper section, a high pressure inlet which is arranged in the control module and which opens out into the drilled hole at the top surface, and wherein the fuel injector is operable to replace fuel which issues from the fuel injector when the nozzle needle lifts from its valve seat by fuel flowing from the high pressure inlet; and wherein the piston guide comprises at least three radially orientated projections which lie adjacent to side surfaces of the nozzle body formed by the drilled hole.

8. The fuel injector according to claim 7, wherein the fuel replacement is performed by way of the drilled hole in the direction of the valve seat.

9. The fuel injector according to claim 7, wherein the spaces between the projections form channels for the fuel.

10. The fuel injector according to claim 7, wherein the piston guide in the area of the upper end of the drilled hole is spaced from the side surfaces of the needle body formed by the drilled hole such that an annular channel is formed for the fuel.

11. The fuel injector according to claim 7, further comprising a valve chamber which is separated from a return line by means of a control valve.

12. The fuel injector according to claim 11, wherein high pressure is applied to the valve chamber by way of a bypass restrictor, whereby the bypass restrictor is connected hydraulically to the high pressure inlet.

13. The fuel injector according to claim 12, further comprising a control chamber which lies adjacent to the upper end of the control piston, wherein high pressure is applied to the control chamber by way of an inlet restrictor, whereby the inlet restrictor is connected hydraulically to the high pressure inlet, and wherein the valve chamber and the control chamber are connected to one another by way of an outlet restrictor.

14. The fuel injector according to claim 13, wherein the bypass restrictor lies adjacent to a bypass drilled hole arranged in the control module, which bypass drilled hole opens out into the annular channel.

15. A The fuel injector according to claim 8, wherein the nozzle needle and the control piston are formed as a single piece, and wherein the nozzle needle is spaced from the side surfaces of the needle body formed by the drilled hole.

* * * * *